US006439923B1

(12) United States Patent
Kirkendall et al.

(10) Patent No.: US 6,439,923 B1
(45) Date of Patent: Aug. 27, 2002

(54) UNIVERSAL WIRING HARNESS FOR AUTOMATIC TRANSMISSION

(75) Inventors: W. Scott Kirkendall, Laurinburg; Richard J. Dimond, III, West End, both of NC (US)

(73) Assignee: Rostra Precision Controls, Inc., Laurinburg, NC (US)

( * ) Notice: Subject to any disclaimer, the term of this patent is extended or adjusted under 35 U.S.C. 154(b) by 0 days.

(21) Appl. No.: 09/448,118

(22) Filed: Nov. 24, 1999

(51) Int. Cl.[7] ..... H01R 11/00
(52) U.S. Cl. ..... 439/502
(58) Field of Search ..... 439/34, 502, 623, 439/624; 174/72 A

(56) References Cited

U.S. PATENT DOCUMENTS

| | | | | | |
|---|---|---|---|---|---|
| 3,819,848 | A | * | 6/1974 | Fry | 174/72 A |
| 4,477,801 | A | * | 10/1984 | Robinson, Jr. et al. | 340/684 |
| 5,168,842 | A | * | 12/1992 | Brooks | 123/143 |
| 5,501,605 | A | * | 3/1996 | Ozaki et al. | 439/34 |
| 5,549,344 | A | * | 8/1996 | Nishijima et al. | 296/70 |
| 5,610,447 | A | * | 3/1997 | Nishikawa et al. | 307/38 |
| 5,668,415 | A | * | 9/1997 | Nagami | 307/9.1 |
| 5,829,129 | A | * | 11/1998 | Ito | 29/857 |
| 6,257,923 | B1 | * | 7/2001 | Stone et al. | 439/502 |
| 6,283,789 | B1 | * | 9/2001 | Tsai | 439/502 |

OTHER PUBLICATIONS

THM 4L60–E Internal Wire Harness Identification, ATSG Seminar Information, Slides 23–27, 1997.

* cited by examiner

*Primary Examiner*—Brian Sircus
*Assistant Examiner*—Thanh-Tam Le
(74) *Attorney, Agent, or Firm*—MacMillan, Sobanski & Todd, LLC

(57) ABSTRACT

A universal wiring harness that is capable of providing electrical connections to the various electrical components contained within a variety of vehicular automatic transmissions includes a plurality of electrical conductors that are supported on a relatively rigid support bracket that is shaped in accordance with the basic structure of the transmission such that the electrical conductors are generally directed toward the locations of the various electrical components. The electrical conductors are preferably covered with an electrical insulator that is formed from polytetraflouoroethylene because it provides enhanced resistance to degradation from chemical exposure, heat, penetration (such as from abrasion or cutting), and color fading. A plurality of terminals and connectors are connected to the ends of the electrical conductors so as to facilitate the connections to the various electrical components of the electronic control system. At least some of the terminals and connectors may be adapted to provide alternative electrical connections with some of the components of the transmission, depending upon the particular structure of the transmission. To prevent dirt and other contaminants from entering into the unused terminal, and further to prevent electrical short circuits from occurring, a closure cap can be provided. If desired, the electrical conductors of the two terminal may be spliced together. The provision of multiple terminals and connectors for a single function allows the wiring harness as a whole to be readily adaptable for use with a variety of different transmission structures. As a result, the number of different wire harness structures that is required to be manufactured or maintained in inventory is greatly reduced.

12 Claims, 2 Drawing Sheets

UNIVERSAL WIRING HARNESS FOR AUTOMATIC TRANSMISSION

BACKGROUND OF THE INVENTION

This invention relates in general to automatic transmissions, such as those that are commonly used in the drive trains systems of many automotive and light truck vehicles. In particular, this invention relates to a universal wiring harness that is capable of providing electrical connections between various devices contained within a variety of different automatic transmission structures.

In most vehicles, a transmission is provided in the drive train between the engine and the driven wheels. As is well known, the transmission includes a housing containing an input shaft, an output shaft, and a plurality of gears that can be selectively connected between the input shaft and the output shaft. By controlling the connection of the gears between the input shaft and the output shaft, various forward and reverse gear ratios can be obtained to provide smooth and efficient operation of the vehicle.

In many automatic transmissions, the connection of the gears between the input shaft and the output shaft is controlled by a hydraulic control system that operates a plurality of mechanical clutches. Typically, the hydraulic control system includes a pump that provides pressurized transmission fluid to operate the clutches so as to connect certain ones of the gears contained within the transmission between the input shaft and the output shaft. This is accomplished by providing one or more fluid valves for each of the clutches. By selectively opening and closing the valves, the pressurized fluid from the pump can be controlled so as to operate the clutches to control which of the gears contained within the transmission are connected between the input shaft and the output shaft.

In many recent model automatic transmissions, the operations of the valves contained are controlled electronically by means of an electronic controller. The electronic controller is connected to a plurality of sensors disposed throughout the transmission. The sensors generate electrical signals that are representative of various operating conditions. In response to such electrical signals, the electronic controller generates electrical signals to a plurality of solenoids. The solenoids are connected to operated the various valves contained within the transmission in response to the electrical signals generated by the electronic controller. Thus, as the solenoids are turned on and off by the electronic controller, the various valves are opened and closed, thereby controlling the operations of the clutches and the transmission as a whole.

In such an electronic control system, a plurality of electrical conductors are usually provided to connect the electronic controller to the various sensors, solenoids, and other electrical devices contained within the transmission. Each of the electrical conductors usually includes a length of insulated wire having terminals connected to the ends thereof. The terminals are usually contained within connectors that are sized and shaped to mate with corresponding connectors provided on the various sensors, solenoids, and other electrical devices contained within the transmission to facilitate the connections thereto. As is well known, a typical automatic transmission contains a number of such electrical devices, each of which requires an individual connection. To simplify the installation process, it is known to combine a plurality of the individual electrical conductors into a single wiring harness. A wiring harness is a group of electrical conductors that have been packaged together to simplify the handing thereof and, as a result, facilitate the installation process. Typically, the lengths of wire are bundled packaged together within a single protective cover from which the various terminals and connectors extend at the ends thereof.

As is well known, a wide variety of automatic transmissions are manufactured and sold with modern vehicles. Because they are associated with vehicles of varying size and expense, the structures of such automatic transmissions also vary widely. In particular, the number, type, and location of the various electrical components contained differ from one automatic transmission to another. Thus, although a traditional wiring harness has been found to facilitate the various electrical connections that are made within a single automatic transmission structure, a wide variety of such wiring harnesses must be provided to accommodate the varying structures of automatic transmissions that are manufactured. Unfortunately, it has been found that the manufacture of a wide variety of wiring harness structures is costly and inefficient. Thus, it would be desirable to provide an improved wiring harness that is capable of providing quickly and easily providing electrical connections among a plurality of electrical various devices contained within a variety of different automatic transmission structures.

SUMMARY OF THE INVENTION

This invention relates to a universal wiring harness that is capable of providing electrical connections to the various electrical components contained within a variety of vehicular automatic transmissions. The wiring harness includes a plurality of electrical conductors that are supported on a relatively rigid support bracket that is shaped in accordance with the basic structure of the transmission such that the electrical conductors are generally directed toward the locations of the various electrical components. The electrical conductors are preferably covered with an electrical insulator that is formed from polytetraflouoroethylene because it provides enhanced resistance to degradation from chemical exposure, heat, penetration (such as from abrasion or cutting), and color fading. A plurality of terminals and connectors are connected to the ends of the electrical conductors so as to facilitate the connections to the various electrical components of the electronic control system. At least some of the terminals and connectors may be adapted to provide alternative electrical connections with some of the components of the transmission, depending upon the particular structure of the transmission. To prevent dirt and other contaminants from entering into the unused terminal, and further to prevent electrical short circuits from occurring, a closure cap can be provided. If desired, the electrical conductors of the two terminal may be spliced together. The provision of multiple terminals and connectors for a single function allows the wiring harness as a whole to be readily adaptable for use with a variety of different transmission structures. As a result, the number of different wire harness structures that is required to be manufactured or maintained in inventory is greatly reduced.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
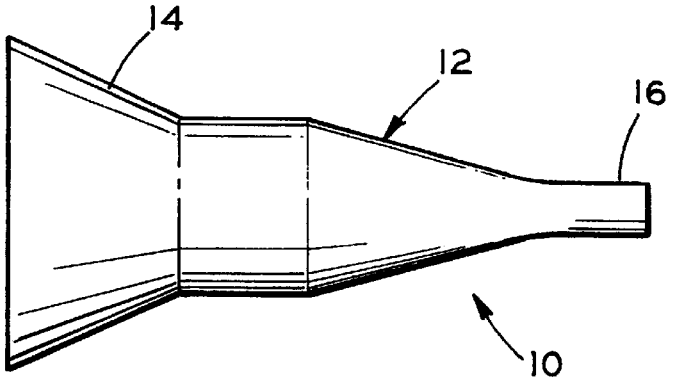
FIG. 1 is a side elevational view schematically illustrating a conventional automatic transmission with which a universal wiring harness in accordance with this invention may be used.

Referring now to the drawings, there is schematically illustrated in FIG. 1 an automatic transmission, indicated generally at 10, that is generally known in the art. The illustrated transmission 10 is intended to be representative of any type of automatic transmission, such as for use in vehicles. The basic structure and operation of the transmission 10 is well known in the art. Thus, only those portions of the transmission 10 that are necessary for an understanding of this invention will be explained and illustrated.

The transmission 10 includes a case or housing 12 having an input end 14 and an output end 16. As is well known, the housing 12 contains an input shaft (not shown) that extends inwardly though the input end 14 thereof, an output shaft (not shown) that extends outwardly from the output end 16 thereof, and a plurality of gears (not shown) that can be selectively connected between the input shaft and the output shaft. The input shaft is typically rotatably driven by a source of rotational power, such as a vehicle engine, and the input shaft may, for example, be embodied as an output shaft of such a vehicle engine. The output shaft is typically connected through a driveshaft to an axle assembly or other mechanism for rotating the wheels of the vehicle when rotatably driven by the input shaft. By controlling the connection of the gears, various forward and reverse gear ratios can be obtained to provide smooth and efficient operation of the vehicle.

The connection of the gears contained within the transmission 10 between the input shaft and the output shaft is usually controlled by a hydraulic control system that operates a plurality of mechanical clutches. Typically, the hydraulic control system includes a pump that provides pressurized transmission fluid to operate the clutches so as to connect certain ones of the gears contained within the transmission 10 between the input shaft and the output shaft. This is accomplished by providing one or more fluid valves for each of the clutches. By selectively opening and closing the valves, the pressurized fluid from the pump can be controlled so as to operate the clutches to control which of the gears contained within the transmission 10 are connected between the input shaft and the output shaft.

Figure 2:
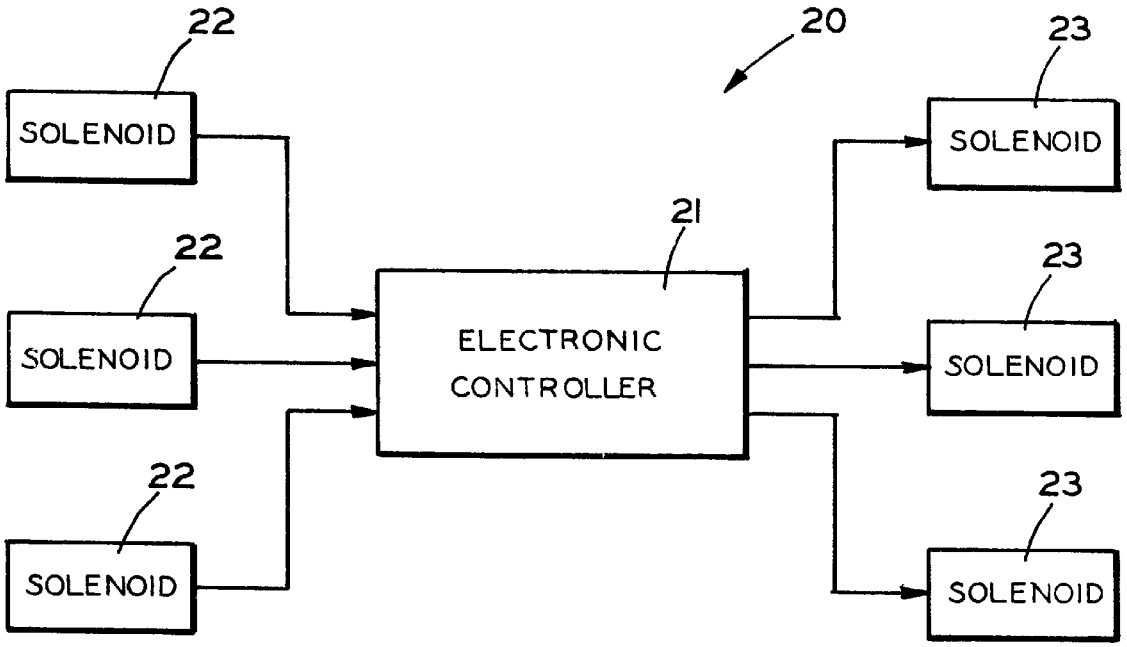
FIG. 2 is a block diagram of an electronic control circuit for use with the automatic transmission illustrated in FIG. 1.

FIG. 2 is a block diagram of an electronic control system, indicated generally at 20, for use with the automatic transmission 10 illustrated in FIG. 1. The electronic control system 20 includes an electronic controller 21, which may be embodied as any known electronic computing device, such as a microprocessor, a programmable logic controller, and the like. The electronic controller 21 is connected to a plurality of sensors, switches, or other input devices 22 that are disposed throughout the transmission 10. The sensors 22 generate electrical signals that are representative of various sensed operating conditions. The electronic controller 21 is also connected to a plurality of solenoids or other output devices 23 that are associated with the valves of the hydraulic control system described above. Operation of the solenoids 23 causes the associated valves to be opened and closed. In a manner that is well known in the art, the electronic controller 21 receives the electrical signals that are generated by the sensors 22. In response to such signals, the electronic controller generates electrical signals to the solenoids 23. The solenoids 23 are operated so as to selectively open and close the various valves contained within the transmission 10. Thus, as the solenoids are turned on and off by the electronic controller, the various valves are opened and closed to control the operation of the transmission 10 in the manner described above.

Figure 3:
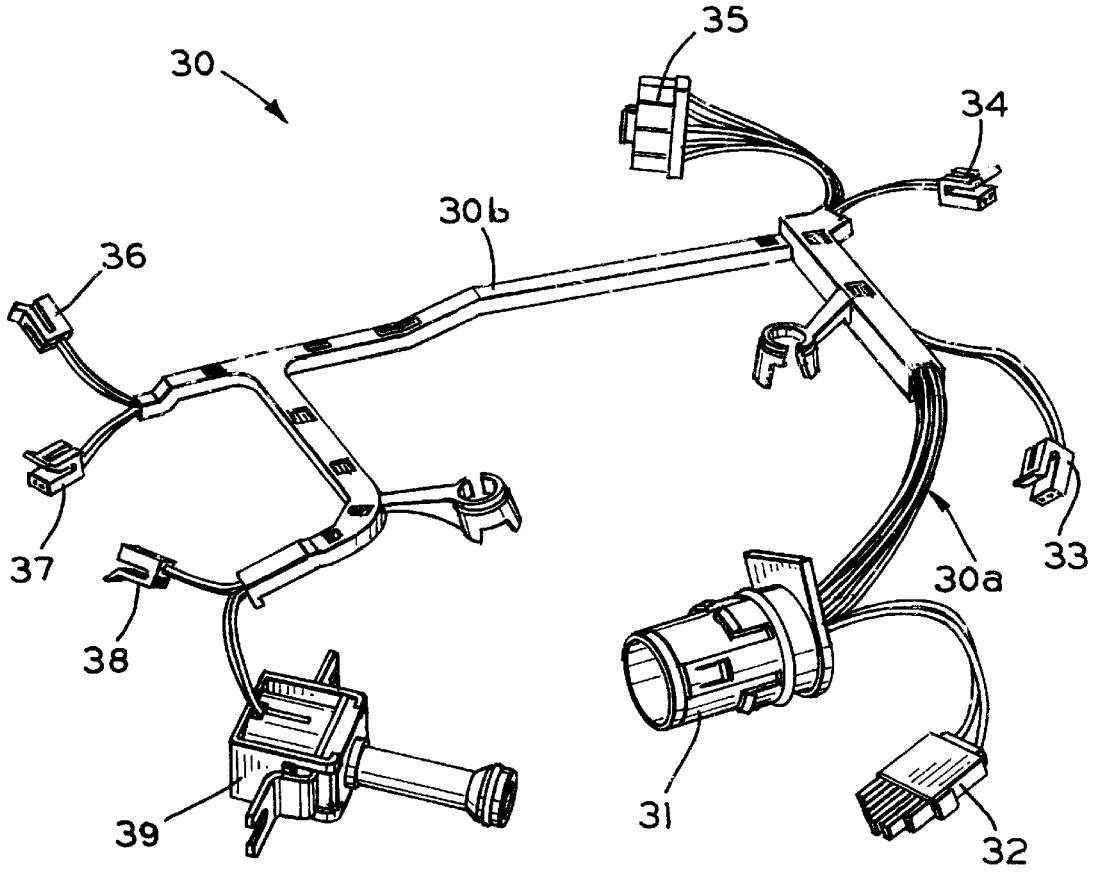
FIG. 3 is a perspective view of a universal wiring harness in accordance with this invention for use in the electronic control circuit of FIG. 2.

Referring now to FIG. 3, there is illustrated a universal wiring harness, indicated generally at 30, in accordance with this invention. The wiring harness 30 is provided to facilitate the electrical connections between the electronic controller 21, the sensors 22, and the solenoids 23 discussed above. To accomplish this, the wiring harness includes a plurality of electrical conductors, several of which are indicated generally at 30*a*, that are supported on a relatively rigid support bracket 30*b*. The support bracket 30*b* is shaped in accordance with the basic structure of the transmission 10 such that the electrical conductors 30*a* are generally directed toward the locations of the various electrical components 21, 22 and 23.

The electrical conductors 30*a* are preferably covered with an electrical insulator that is formed from polytetraflouroethylene (PTFE). The use of a PTFE covering on the electrical conductors 30*a* is desirable because it provides enhanced resistance to degradation from chemical exposure, heat, and penetration, such as from abrasion or cutting. The use of a PTFE covering on the electrical conductors 30*a* is also desirable because it resists color fading. It is known to color code the various electrical conductors 30*a* to correspond with the various electrical components 21, 22, and 23 to which they are attached. Traditionally, the color coding has been accomplished by providing a neutrally colored insulator with a colored coating. However, it has been found that after a period of use, the colored coating can be removed because of chemical reactions or physical wear. When this occurs, the possibility of an erroneous connection is increased. To avoid this, the PTFE covering on the electrical conductors 30*a* resists color fading, even after an extended period of use. The support bracket 30*b* can be formed from any desired material. Preferably, however, the support bracket 30*b* is formed from a non-metallic material that is resistant to heat and corrosion, such as polyamide.

A plurality of connectors 31 through 38 are connected to the ends of the electrical conductors 31*a* so as to facilitate the connections to the various electrical components 21, 22 and 23 of the electronic control system 20. As is well known, one or more electrical terminals (not shown) are housed within each of the connectors 31 through 38. The size and shape of each of such connectors 31 through 38 can be selected to correspond with the specific one of the components 21, 22, and 23 to which it is to be connected. For example, the connector 31 may be adapted to provide an electrical connection with the electronic controller 21. The connector 32 may be adapted to provide an electrical connection with an EPC force motor. The connectors 33 and 34 may be adapted to provide electrical connections with respective shift solenoids. The connector 35 may be adapted to provide an electrical connection with a pressure switch assembly or other one of the sensors 22. The connectors 36 and 37 may be adapted to provide alternative electrical connections with a downshift pulse width modulation controller. The connector 38 may be adapted to provide an electrical connection with a torque converter control pulse width modulation controller. Lastly, one of the electrical conductors 30*a* may be hard wired to one of the solenoids 23.

Figure 4:
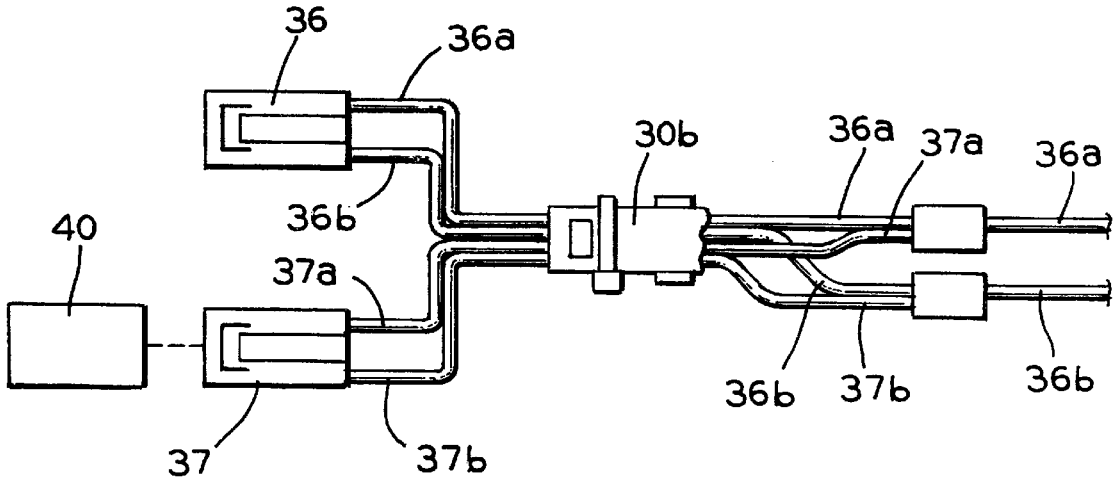
FIG. 4 is an enlarged elevational view of a portion of the universal wiring harness illustrated in FIG. 3.

Referring now to FIG. 4, there is illustrated a portion of the wiring harness 30 illustrated in FIG. 3, including the connectors 36 and 37. As discussed above, the connectors 36 and 37 may be adapted to provide alternative electrical connections with a downshift pulse width modulation controller. For example, the connector 36 may be sized and shaped to be utilized with a downshift pulse width modulation controller from a first model year or group of model years, while the connector 37 may be sized and shaped to be utilized with a downshift pulse width modulation controller from a second model year or group of model years. Only one of the two connectors 36 and 37 is intended to be used in any given transmission 10. Thus, depending upon the model year of the transmission 10, either the connector 36 or the connector 37 will be connected to the downshift pulse width modulation controller. For example, if the connector 36 is connected to the downshift pulse width modulation controller, the connector 37 will not be connected to anything. To prevent dirt and other contaminants from entering into the unused connector 37, and further to prevent electrical short circuits from occurring, a closure cap 40 is provided. The closure cap 40 is provided to protectively cover the open end of the unused connector 37 to prevent the entry of dirt, water, and other contaminants therein.

The first connector 36 has first and second electrical conductors 36*a* and 36*b* extending therefrom, while the second connector 37 has first and second electrical conductors 37*a* and 37*b* extending therefrom. If desired, the first electrical conductors 36*a* and 37*a* of the two connectors 36 and 37 may be spliced together to provide a single electrical conductor 36*a* extending therefrom. Similarly, the second electrical conductors 36*b* and 37*b* of the two connectors 36 and 37 may be spliced together to provide a single electrical conductor 36*b* extending therefrom. In this situation, the connectors 36 and 37 are functionally equivalent to one another, but are adaptable for use with corresponding connectors of differing size and shape. The provision of multiple connectors, such as the connectors 36 and 37, for a single function allows the wire harness 30 as a whole to be readily adaptable for use with a variety of different transmission structures. As a result, the number of different wire harness structures that is required to be manufactured or maintained in inventory is greatly reduced.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A wiring harness that is adapted to provide electrical connections between an electronic controller and one of a plurality of different automatic transmissions, wherein each of the different automatic transmissions has a plurality of electrical components provided thereon, said wiring harness comprising:

a plurality of electrical conductors that are bundled together on a support, each of said electrical conductors including a first end and a second end;

a first plurality of terminals and connectors that are connected to said first ends of said electrical conductors to facilitate the connection of said electrical conductors to the electronic controller; and a second plurality of terminals and connectors that are connected to said second ends of said electrical conductors to facilitate the connection of said electrical conductors to the electrical components of a selected one of the plurality of automatic transmissions, wherein at least one of said electrical conductors has at least two of said terminals and connectors connected to said second end thereof to provide alternative electrical connections with one of the electrical components of the selected one of the plurality of automatic transmissions, wherein only one of said at least two of said terminals and connectors is used at a time.

2. The wiring harness defined in claim 1 wherein said support is a rigid support.

3. The wiring harness defined in claim 2 wherein said support is formed from formed from a non-metallic material that is resistant to heat and corrosion.

4. The wiring harness defined in claim 3 wherein said support is formed from polyamide.

5. The wiring harness defined in claim 1 wherein said at least two of said terminals and connectors are spliced to said second end of said electrical conductor.

6. The wiring harness defined in claim 1 further including a closure cap that protectively covers the unused one of said at least two of said terminals and connectors connected to said second end of said electrical conductor.

7. An electronic control system for use with one of a plurality of different automatic transmissions, wherein each of the different automatic transmissions has a plurality of electrical components provided thereon, said electronic control system comprising:

a plurality of input devices for generating electrical signals that are representative of operating conditions of the automatic transmission;

a plurality of output devices for controlling the operation of the automatic transmission;

an electronic controller that is responsive to said electrical signals from said input devices for generating electrical signals to said output devices; and a wiring harness that provides electrical connections between said input devices, said electronic controller, and said output devices, said wiring harness including:

a plurality of electrical conductors that are bundled together on a support, each of said electrical conductors including a first end and a second end;

a first plurality of terminals and connectors that are connected to said first ends of said electrical conductors to facilitate the connection of said electrical conductors to said input devices, said electronic controller, and said output devices; and a second plurality of terminals and connectors that are connected to said second ends of said electrical conductors to facilitate the connection of said electrical conductors to the electrical components of a selected one of the plurality of automatic transmissions, wherein at least one of said electrical conductors has at least two of said terminals and connectors connected to said second end thereof to provide alternative electrical connections with one of the electrical components of the selected one of the plurality of automatic transmissions.

8. The electronic control system defined in claim 7 wherein said support is a rigid support.

9. The electronic control system defined in claim 8 wherein said support is formed from formed from a non-metallic material that is resistant to heat and corrosion.

10. The electronic control system defined in claim 9 wherein said support is formed from polyamide.

11. The electronic control system defined in claim 7 wherein said at least two of said terminals and connectors are spliced to said second end of said electrical conductor.

12. The electronic control system defined in claim 7 further including a closure cap that protectively covers the unused one of said at least two of said terminals and connectors connected to said second end of said electrical conductor.

* * * * *

UNITED STATES PATENT AND TRADEMARK OFFICE

CERTIFICATE OF CORRECTION

PATENT NO. : 6,439,923 B1
DATED : August 27, 2002
INVENTOR(S) : W. Scott Kirkendall and Richard J. Dimond, III It is certified that error appears in the above-identified patent and that said Letters Patent is hereby corrected as shown below:

Column 6,
Line 47, after "transmissions" insert -- , wherein only one of said at least two of said terminals and connectors is used at a time. --

Signed and Sealed this

Fourth Day of February, 2003

JAMES E. ROGAN
*Director of the United States Patent and Trademark Office*